US009423204B2

(12) United States Patent
Park et al.

(10) Patent No.: US 9,423,204 B2
(45) Date of Patent: Aug. 23, 2016

(54) RECURVED BOW WITH IMPROVED VIBRATION DAMPING FUNCTION

(71) Applicant: WIN & WIN Co., Ltd., Gyeonggi-do (KR)

(72) Inventors: Dong Won Park, Seoul (KR); Seung Woo Shin, Chungcheongnam-do (KR)

(73) Assignee: Win & Win Co., Ltd. (KR)

( * ) Notice: Subject to any disclaimer, the term of this patent is extended or adjusted under 35 U.S.C. 154(b) by 0 days.

(21) Appl. No.: 15/001,680

(22) Filed: Jan. 20, 2016

(65) Prior Publication Data

US 2016/0209158 A1 Jul. 21, 2016

(30) Foreign Application Priority Data

Jan. 20, 2015 (KR) ..... 20-2015-0000445 U

(51) Int. Cl.
*F41B 5/00* (2006.01)
*F41B 5/14* (2006.01)

(52) U.S. Cl.
CPC ..... *F41B 5/1426* (2013.01); *F41B 5/00* (2013.01); *F41B 5/0005* (2013.01)

(58) Field of Classification Search
CPC ..... F41B 5/00; F41B 5/14; F41B 5/1426
See application file for complete search history.

(56) References Cited

U.S. PATENT DOCUMENTS 3,196,860 A * 7/1965 Hoyt, Jr. ..... F41B 5/1426 124/24.1
3,412,725 A * 11/1968 Hoyt, Jr. ..... F41B 5/1426 124/84
5,592,929 A * 1/1997 Hoyt, Jr. ..... F41B 5/1438 124/23.1
5,660,158 A * 8/1997 Rudolph ..... F41B 5/0026 124/23.1
5,967,130 A * 10/1999 Sugauchi ..... F41B 5/1426 124/23.1
6,526,957 B1 * 3/2003 Leven ..... F41B 5/1426 124/89

* cited by examiner

*Primary Examiner* — John Ricci
(74) *Attorney, Agent, or Firm* — Berenato & White, LLC

(57) ABSTRACT

Provided is a recurved bow including: a handle; a pair of limbs coupled at both ends of the handle; and a bowstring, wherein a projecting coupling member is provided in front of each of the limbs, and is extended forwardly from each of the limbs, and has a coupling portion in the front thereof, and is coupled with a coupling pin of a rear side of each of the limbs, and wherein a damper member is provided in which the damper member comprises a corresponding coupler that is coupled with the coupling portion formed in front of each of the projecting coupling member, and a damper coupled with the front of the corresponding coupler, to thereby rapidly damp vibrations generated in one end of each of the limbs to thus enhance a vibration damping function.

5 Claims, 6 Drawing Sheets

RECURVED BOW WITH IMPROVED VIBRATION DAMPING FUNCTION

CROSS-REFERENCE TO RELATED APPLICATION

This application claims the benefit of Korean Utility-Model Application No. 20-2015-0000445, filed on Jan. 20, 2015, in the Korean Intellectual Property Office, the disclosure of which is incorporated in its entirety herein by reference.

FIELD OF THE INVENTION

The present invention relates to a recurved bow, and more particularly, to a recurved bow that damps vibrations generated in the end portions of limbs coupled to a handle in use of the recurved bow to thereby improve accuracy of an arrow.

BACKGROUND OF THE INVENTION

At present, recurved bows are used as bows for a game of European archery, and as shown in FIG. 1, each of the recurved bows includes: a handle 10 at the center of which a grip 11 grasped by a user is formed; a pair of limbs 20 coupled at both ends of the handle 10; and a bowstring 30 that is connected between the limbs 20. In addition, as shown in FIG. 2, the limbs 20 are coupled with the handle 10 in which fixing pins 12 respectively formed at both end portions of the handle 20 are respectively inserted into fitting grooves 21 of the limbs 20, to thus support each end of the limbs 20, and coupling pins 22 respectively formed at both end portions of the limbs 20 are respectively coupled into coupling grooves 13 formed in both end portions of the handle 10.

However, the conventional bow may cause the limbs 20 of the bow to be bent back when the bowstring 30 is pulled in use of the bow. Accordingly, as shown in FIG. 2, a displacement (a dashed line portion of FIG. 2) may occur at one end of each of the limbs 20 coupled with the handle 10. As a result, vibrations generated at the time of firing an arrow are finally transmitted to the handle to thereby degrade accuracy of the arrow. In this case, narrowing a distance between the fixing pin 12 and the coupling groove 13 that secure the limbs 20 in order to reduce the displacement, may have a problem of causing a small vibration amplitude but keeping the vibration for long. Meanwhile, widening the distance between the fixing pin 12 and the coupling groove 13 may have a problem of causing a large vibration damping speed but a large vibration amplitude.

SUMMARY OF THE INVENTION

To solve the above conventional problems or defects, it is an object of the present invention to provide a recurved bow for improving accuracy of an arrow by damping and rapidly absorbing vibrations generated in the end portions of limbs coupled to a handle.

In addition, it is another object of the present invention to provide a recurved bow for enhancing vibration damping functions in which the bow can damp vibrations generated from bow limbs without changing structure of an existing recurved bow, to thereby increase cost-efficiency.

To accomplish the above and other objects of the present invention, according to an aspect of the present invention, there is provided a recurved bow comprising: a handle at the center of which a grip grasped by a user is formed; a pair of limbs coupled at both ends of the handle; and a bowstring that is connected between the pair of limbs, wherein a coupling pin is formed in one end of a rear side of each of the limbs coupled to the handle, and a fitting groove is formed in one end of each of the limbs, wherein a coupling groove is formed in either end of the handle with which each of the limbs is coupled in which the coupling pin of each of the limbs is coupled into the coupling groove, and a fixing pin is formed at either end portion of the handle in which the fixing pin is inserted into the fitting groove of each of the limbs, to thus support each end of the limbs, wherein a projecting coupling member is provided in front of each of the limbs, and is extended forwardly from each of the limbs, and has a coupling portion in the front thereof, and is coupled with the coupling pin of a rear side of each of the limbs, and wherein a damper member is provided in which the damper member comprises a corresponding coupler that is screw-coupled with the coupling portion formed in front of each of the projecting coupling member, and a damper coupled with the front of the corresponding coupler, to thereby rapidly damp vibrations generated in one end of each of the limbs to thus enhance a vibration damping function.

Preferably but not necessarily, a female thread is formed in the front surface of the projecting coupling member as the screw-coupling portion formed in front of the projecting coupling member and a male thread is formed in the corresponding screw coupler of the damper member.

Preferably but not necessarily, the damper member is made of a rubber.

Preferably but not necessarily, a coupling projection is formed in the coupling pin of each of the limbs in which the coupling projection is protrudes to the rear of the coupling pin and is inserted into an insertion groove formed on the bottom of the coupling groove of the handle, and wherein a spring member that elastically supports the coupling projection is provided in an inner space of the coupling pin.

Preferably but not necessarily, the damper member is disposed on the same axial line as that of the spring member of the coupling pin.

As described above, the present invention provides a recurved bow with an improved vibration damping function in which the recurved bow quickly damps an amplitude of vibrations generated on limbs to improve accuracy of an arrow.

DETAILED DESCRIPTION OF THE PREFERRED EMBODIMENT(S)

The above and/or other objects and/or advantages of the present invention will become more apparent by the following description of embodiments of the present invention.

Figure 3:
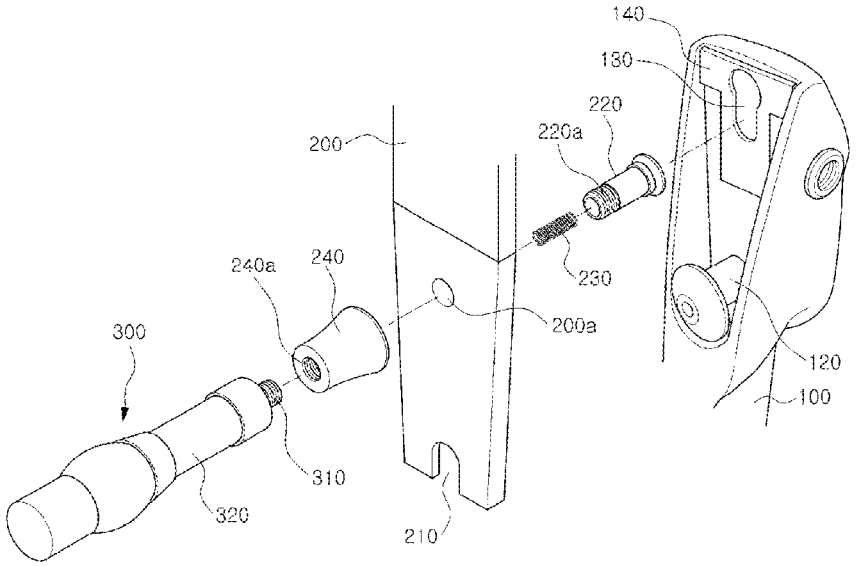
FIG. 3 is a partially exploded perspective view of a recurved bow according to an embodiment of this invention.
Figure 4:
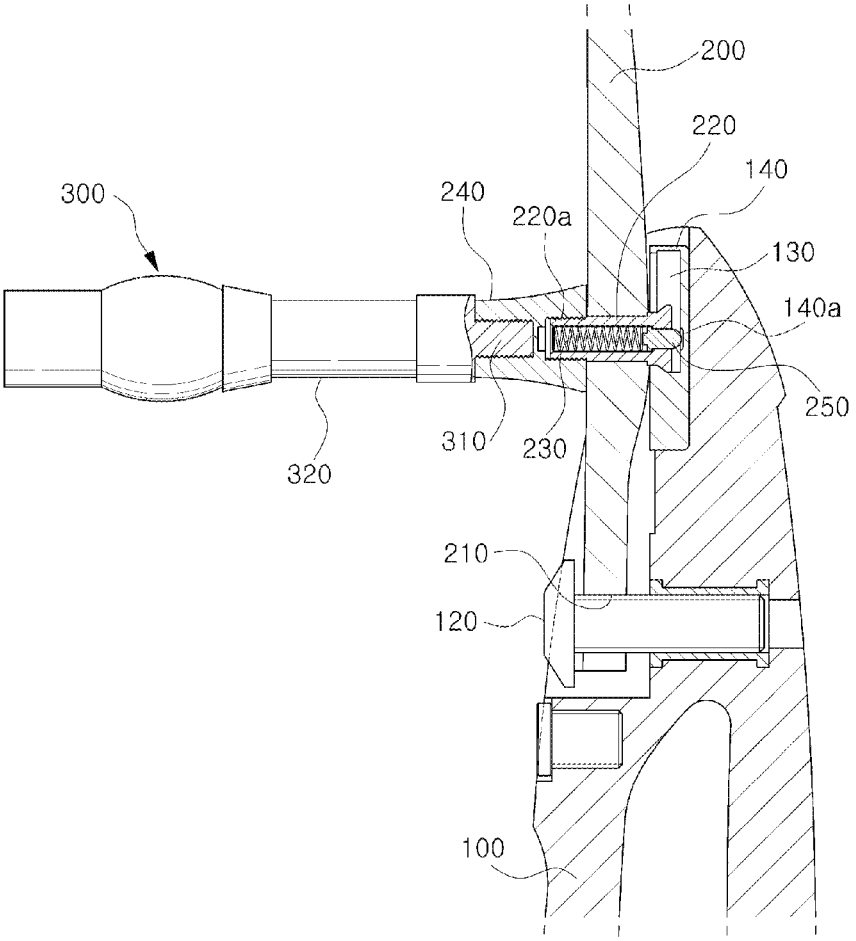
FIG. 4 is a partial side view of a recurved bow according to an embodiment of this invention.
Figure 5A:
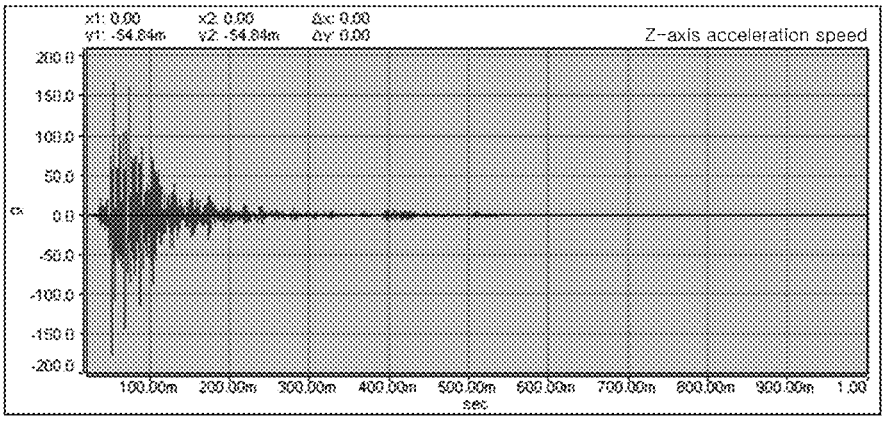
FIGS. 5A and 5B are graphical views for comparing vibrations generated from a conventional bow and a bow according to an embodiment of this invention.
Figure 5B:
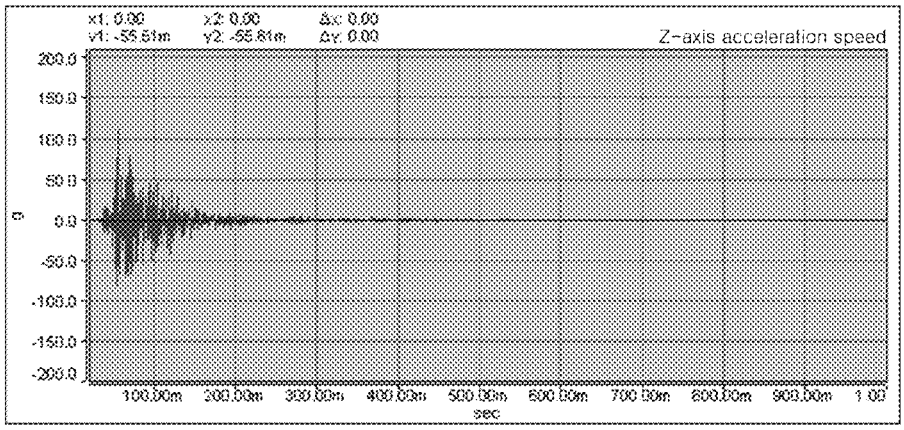

FIG. 3 is a partially exploded perspective view of a bow according to an embodiment of this invention. FIG. 4 is a partial side view of a bow according to an embodiment of this invention. FIGS. 5A and 5B are graphical views for comparing vibrations generated from a conventional bow and a bow according to an embodiment of this invention.

As shown, a recurved bow includes: a handle 100 at the center of which a grip 11 (of FIG. 1) grasped by a user is formed; a pair of limbs 200 coupled at both ends of the handle 100; and a bowstring that is connected between the pair of limbs 200, wherein a coupling pin 220 is formed in one end of a rear side of each of the limbs 200 coupled to the handle 100, and a fitting groove 210 is formed in one end of each of the limbs 200, wherein a coupling groove 130 is formed in either end of the handle 100 with which each of the limbs 200 is coupled in which the coupling pin 220 of each of the limbs 200 is coupled into the coupling groove 130, and a fixing pin 120 is formed at either end portion of the handle 100 so as to be inserted into the fitting groove 210 of each of the limbs 200, wherein a projecting coupling member is formed with a coupling portion 240*a* of a male or female screw in the front thereof, and is disposed in front of each of the limbs 200, and is coupled with the coupling pin 220 of a rear side of each of the limbs 200, and wherein a damper member 300 is provided in which the damper member 300 comprises a corresponding coupler 310 that is screw-coupled with the coupling portion 240*a* formed in front of each of the projecting coupling member 240, and a damper 320 coupled with the front of the corresponding screw coupler 310.

The grip 11 (of FIG. 1) grasped by a user is formed at the center of the handle 100, and the pair of limbs 200 are coupled at both ends of the handle 100. A coupling groove 130 is formed at either end of the handle 100 so that each of the limbs 200 is coupled with the handle 100, and a fixing pin 120 is formed at a distance in the central direction of the coupling groove 130 from the coupling groove 130.

The fixing pin 120 for fixing and supporting one end of each of the limbs 200 coupled to the handle 100, is detachably screw-coupled with the handle 100. A projecting height of a head portion of the fixing pin 120 is adjusted by rotating the fixing pin 120, to thereby adjust the strength of each of the limbs 200.

The coupling groove 130 is formed at either end of the handle 100, in which a coupling pin 220 of each of the limbs 200 to be described later is inserted into the coupling groove 130. The coupling pin 220 of each of the limbs 200 is inserted through the top of the coupling groove 130, and then each of the limbs 200 is coupled downwards toward the center of the handle 100. An opening width of a lower portion of the coupling groove 130 is formed smaller than that of the coupling pin 130 so that the coupled coupling pin 130 is not seceded to the front side. In addition, an insertion groove 140*a* is formed on the bottom surface of the coupling groove 130, in which a coupling projection 250 protruded from the coupling pin 220 of each of the limbs 200 is inserted into and fixed to the insertion groove 140*a*.

Meanwhile, in an example shown in FIG. 3, a T-shaped limb coupling block 140 that is coupled detachably to each of ends of the handle 100 is formed at each of ends of the handle 100, so that the coupling groove 130 is formed in the limb coupling block 140. However, the coupling groove 130 may be formed at the end of the handle 100 without a separate block, and a variety of modifications of the shape of the coupling groove 130 may be allowed as long as the coupling pin 220 is inserted into and fixed to the coupling groove 130.

A fitting groove 210 is formed in a predetermined length at the end of each of the limbs 200 so as to be inserted into and fixed to the fixing pin 120 of the handle 100 in order to be coupled with the handle 100. In addition, the coupling pin 220 coupled into the coupling groove 130 of the handle 100 is formed at one side of a rear surface of one end of each of the limbs 200.

The coupling projection 250 projected in the rear side of the coupling pin 220 and inserted into the insertion groove 140*a* of the handle 100 is formed at the coupling pin 220. In addition, a spring member 230 is inserted into the inner space of the coupling pin 220, to thus elastically support the coupling projection 250. Meanwhile, a thread 220*a* is formed in the front outer peripheral surface of the coupling pin 220, so as to be screwed to the rear surface of the projecting coupling member 240.

The projecting coupling member 240 is disposed in front of each of the limbs 200 and is coupled with the coupling pin 220 through a throughhole 200*a* formed in each of the limbs 200 at the rear side of the projecting coupling member 240. The projecting coupling member 240 is coupled with the damper member 300 in front of the projecting coupling member 240. The projecting coupling member 240 is extended forwardly so as to protrude by a predetermined length from each of the limbs 200. A female screw is formed at the rear surface of the projecting coupling member 240 for coupling with the coupling pin 220, and is screw-coupled with the thread 220*a* formed in front of the outer peripheral surface of the coupling pin 220. In addition, coupling portion 240*a* is formed in the front surface of the projecting coupling member 240 for coupling with the corresponding coupler 310 of the damper member 300. As shown in this embodiment, the female screw is formed as the coupling portion 240*a* of the projecting coupling member 240.

The damper member 300 is coupled to the front surface of the projecting coupling member 240 to thus damp the vibrations of each of the limbs 200, and is disposed on the same axial line as that of the spring member 230. In addition, the damper member 300 includes: the corresponding screw coupler 310 that is screw-coupled with the screw-coupling portion 240*a* formed in front of each of the projecting coupling member 240, and the damper 320 coupled with the front of the corresponding screw coupler 310. The corresponding screw coupler 310 is made of a male screw so as to be coupled to a female screw of the projecting coupling members 240. The damper 320 is coupled to the front of the corresponding screw coupler 310, and is made of a rubber material in a bar form in this embodiment. Meanwhile, according to the present embodiment, the corresponding screw coupler 310 is made of a male screw. However, in other embodiments, a male screw may be formed in front of the projecting coupling member 240 and a female screw may be formed in the corresponding screw coupler 310 so as to be coupled with the projecting coupling member 240. And, besides screw coupling, another coupling structure between the projecting coupling member 240 and the damper member 300 is also possible.

Figure 1:
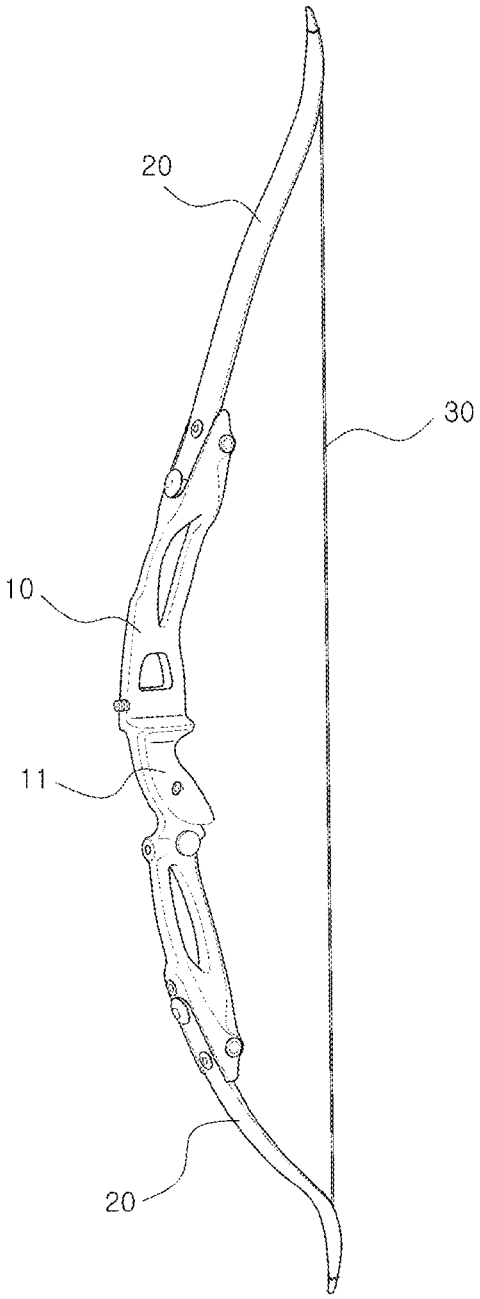
FIG.1 (PRIOR ART)
FIG. 1 is a perspective view of a conventional recurved bow.
Figure 2:
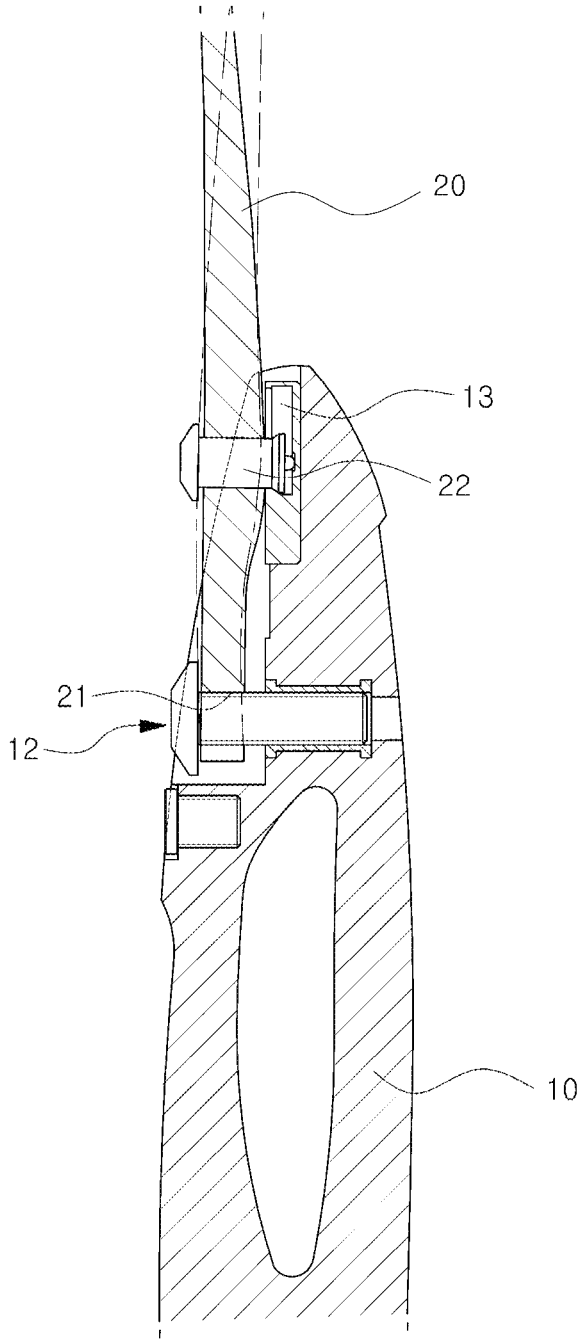
FIG.2 (PRIOR ART)
FIG. 2 is a partially enlarged view of FIG. 1.

Vibrations generated from the recurved bow according to an embodiment of this invention having the configuration as described above, when the bowstring is released, are compared with vibrations generated from an existing recurved bow as in FIG. 1, when the bowstring is released, and thus the vibrations results are illustrated in FIGS. 5A and 5B, in which the x-axis indicates the time, and the y-axis indicates the amplitude. FIG. 5A shows vibrations generated from an existing recurved bow as in FIG. 1, when the bowstring is released, and FIG. 5B shows vibrations generated from the recurved bow according to an embodiment of this invention having the configuration as described above, when the bowstring is released. As it can be seen from FIGS. 5A and 5B, it can be seen that the amplitude of the vibrations of the recurved bow according to an embodiment of this invention when the bowstring is released has been significantly reduced when compared with those of the existing recurved bow, and it can be also seen that the reduction in the time has been also significantly reduced. This means not only the size of the vibration is decreased but duration of vibration is also reduced.

In the conventional recurved bow, the limbs of the recurved bow are bent back when the bowstring is pulled, and a displacement may occur at one end of each of the limbs coupled with the handle. As a result, vibrations generated from the limbs at the time of firing an arrow are finally transmitted to the handle to thereby degrade accuracy of the arrow. However, according to the embodiments of the present invention, the projecting coupling member 240 is coupled with the coupling pin 220 of each of the limbs 200 so as to be coupled with and at the end of the handle 100 and the projecting coupling member 240 is coupled with the damper member 300, to thereby damp vibrations generated from the limbs when the bowstring is released significantly and quickly.

In particular, the limbs 200 are bent back when the bowstring 30 is released, and the coupling pin 220 that secures each of the limbs 200 to the handle 100 is positioned at the distal end from the middle of the handle 100. According to the embodiments of the present invention, as described above, the damper member 300 is coupled on the axial line of the coupling pin 220 with the coupling pin 220 through the projecting coupling member 240 so that the damper member 300 protrudes forwardly in which the coupling pin 220 serves to act as a support point at the end of the handle 100, to thereby lead to a remarkable vibration damping effect as described above.

In addition, according to the embodiments of the present invention, the damper member 300 is coupled with the coupling pin 220 through the projecting coupling member 240, and the spring member 230 that elastically supports the insertion projection 250 is formed in the coupling pin 220 to be fixed to the coupling groove 130 of the handle 100. Since the damper member 300 is coupled on the same axial line as that of the spring member 230, the spring member 230 that is formed on the same axial line as that of the damper member 300 leads to a synergistic effect on the damping of the vibrations generated from the limbs when the bowstring is released.

Therefore, in the case of the recurved bows in accordance with the embodiments of the present invention, vibrations transmitted to the handle from the limbs at firing an arrow are reduced significantly and quickly, to thus also provide an effect of enhancing accuracy of the arrow.

As described above, the present invention has been described with respect to particularly preferred embodiments. However, the present invention is not limited to the above embodiments, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

What is claimed is:

1. A recurved bow, comprising:

a handle at the center of which is formed a grip grasped by a user;

a pair of limbs coupled at both ends of the handle; and a bowstring that is connected between the pair of limbs, wherein a coupling pin is formed in a rear side of each of the limbs coupled to the handle, and a fitting groove is formed in one end of each of the limbs, wherein a coupling groove is formed in either end of the handle with which each of the limbs is coupled in which the coupling pin of each of the limbs is coupled into the coupling groove, and a fixing pin is formed at either end portion of the handle in which the fixing pin is inserted into the fitting groove of each of the limbs, to thus support each end of the limbs, wherein a projecting coupling member is provided in front of each of the limbs, and is extended forwardly from each of the limbs, and has a coupling portion in the front thereof, and is coupled with the coupling pin of a rear side of each of the limbs, and wherein a damper member is provided in which the damper member comprises a corresponding coupler that is coupled with the coupling portion formed in front of each of the projecting coupling member, and a damper coupled with the front of the corresponding coupler, to thereby rapidly damp vibrations generated in one end of each of the limbs to thus enhance a vibration damping function.

2. The recurved bow of claim 1, wherein a female thread is formed in the front surface of the projecting coupling member as the coupling portion formed in front of the projecting coupling member and a male thread is formed in the corresponding coupler of the damper member.

3. The recurved bow of claim 1, wherein the damper is made of a rubber.

4. The recurved bow of claim 1, wherein a coupling projection is formed in the coupling pin of each of the limbs in which the coupling projection is protrudes to the rear of the coupling pin and is inserted into an insertion groove formed on the bottom of the coupling groove of the handle, and wherein a spring member that elastically supports the coupling projection is provided in an inner space of the coupling pin.

5. The recurved bow of claim 4, wherein the damper member is disposed on the same axial line as that of the spring member.

* * * * *